United States Patent [19]

Dotson

[11] 3,975,867

[45] Aug. 24, 1976

[54] HAND-HELD GEM DOP

[75] Inventor: George Dotson, Bliss, Idaho

[73] Assignee: Dotson and Evans Inc., Bliss, Idaho

[22] Filed: May 27, 1975

[21] Appl. No.: 580,621

[52] U.S. Cl. ..... 51/229; 279/35

[51] Int. Cl.[2] ..... B24B 9/16

[58] Field of Search ..... 279/35, 36, 37, 106, 279/107; 51/229

[56] References Cited

UNITED STATES PATENTS

| | | | |
|---|---|---|---|
| 252,404 | 1/1882 | Waterhouse | 279/35 X |
| 567,405 | 9/1896 | McDonald | 279/35 |
| 2,293,641 | 8/1942 | Dinhofer | 51/229 |

*Primary Examiner*—Harold D. Whitehead
*Attorney, Agent, or Firm*—Trask & Britt

[57] ABSTRACT

A hand-held gem dop is described having a slender tubular handle into which is threaded a rod-like component having jaws affixed at the upper end thereof, said jaws actuated by contact with the upper rim of the tubular handle to hold gem stones for polishing. The jaws are angular, opposed and spring-loaded to hold the jaws apart in a normal position. The jaws have removable gem grips thereon which each have a pair of ears to grip a gem stone.

8 Claims, 4 Drawing Figures

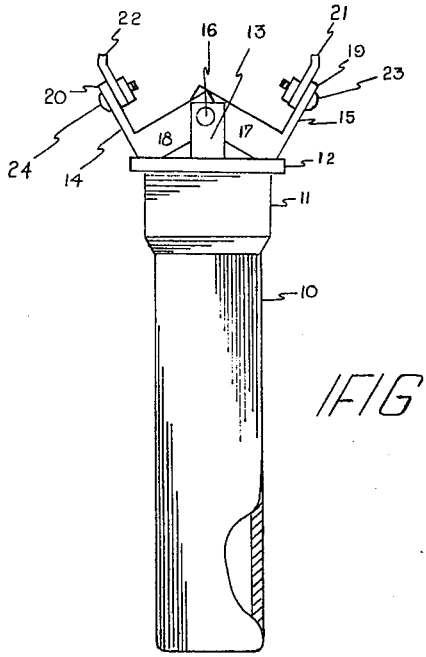
FIG 1
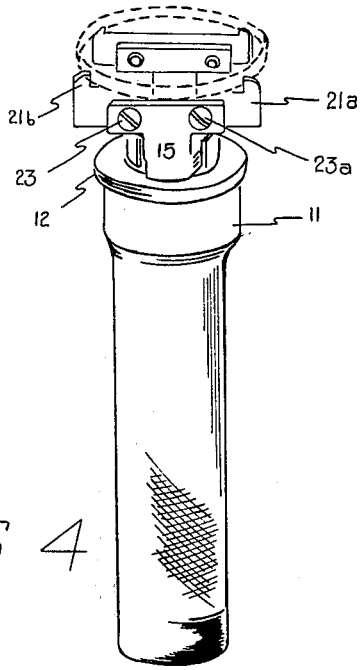
FIG 4
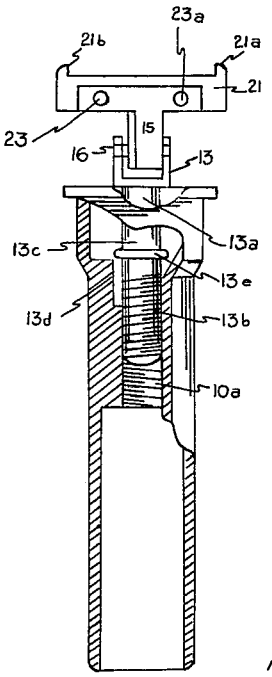
FIG 2
FIG 3
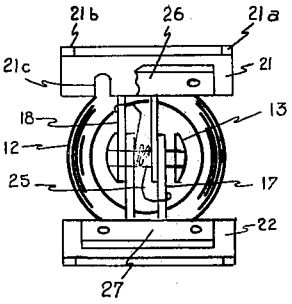

HAND-HELD GEM DOP

BACKGROUND OF INVENTION

1. Field

The invention relates to a tool for securely holding gem stones to be contour ground, sanded and polished in cabochon style with a domed smooth surface.

2. Prior Art

Cabochon type gem stones have conventionally been held for grinding, sanding and polishing, by being adhered to a "dop" stick with wax, which is heated along with the stone to be adhered to the "dop" stick. Gemstones such as agate, jasper, petrified wood, turquoise, and others, are ground and polished with a contoured or domed top surface, and may be oval, round, square or of a freeform overall general outside shape. These domed type cuts are referred to as cabochons or cabs.

Gemstones are cut cabochon style to reveal the beauty of color and included mineral patterns in the stone. A diamond or other fully transparent precious type gemstone generally requires that flat facets be ground on all surfaces of the stone to reflect light from within the stone, and a stone so cut is termed a facet cut stone, instead of a cabochon cut stone.

Holding cabochon type stones on a "dop" stick with wax is a long practice but frequently unsatisfactory technique. During the grinding operation the grinding wheel and stone are showered with water to keep the gemstone from overheating and to flush away loosened grit from wheel and stone. The water often chills the wax, causing the wax to become brittle, break loose, allowing the stone to "pop-off" the stick. Very often the sanding of the stone is done on a motor driven belt or drum covered with dry sanding cloth. This generates heat in the gemstone which heat is transferred to the wax adhering it to the stick, causing the wax to become soft and allow the stone to shift position on the stick or slide from the stick. The polishing of cabochon gemstones is usually performed on a motor driven disc, drum or belt covered with felt or leather. The polishing operation is performed with water mixed with polishing powders applied to the buff. A minimum amount of moisture is used to attain the polish and it is an insufficient amount of moisture to cool the gemstone. As in the sanding operation the gemstone generates heat, softening the wax and allowing stone to shift or release from the stick.

Gem vises have been utilized for holding precious gem stones, particularly diamonds. Exemplary of gem vises are those described in the following patents:

The Lea Patent, U.S. Pat. No. 2,612,735, describes a hand-held vise for ovate stones wherein a thumb screw moves opposed jaws, which are an integral part of a U-shaped vise towards one another.

U.S. Pat. Nos. 2,270,420; 1,147,517; 605,193 are chuck-type holders which have extending fingers which are moved towards one another by circumferential pressure thereon near the base of the fingers within the chuck.

U.S. Pat. Nos. 2,394,242 and 2,390,175 illustrate a dop for holding diamonds, and is similar in construction and operation to the device described in the Lea Patent, i.e., the jaws are moved towards one another by a transverse screw. A similar structure involving one or two thumb screws to move one or both jaws of a vise is described in U.S. Pat. No. 631,562.

The diamond holder illustrated in U.S. Pat. No. 2,309,050 involves a pair of fixed jaws with a movable axial plunger which forces a gem between the jaws.

OBJECTS OF THE INVENTION

It is an object of the instant invention to provide a hand-held vise which is compact and firmly holds cabochon-type stones for grinding, sanding and polishing.

Another object of the invention is to provide a gem stone vise which is simple in function and has a positive gripping action.

A further object of the instant invention is to provide a hand-held gem vise which accommodates various sizes and shapes of cabochon-type stones.

DESCIPTION OF THE DRAWINGS

The invention is illustrated by the following figures wherein;

FIG. 1 is an elevational view of the hand-held gem dop;

FIG. 2 is an elevational view of the hand-held gem dop with a cut-away section to expose the interior;

FIG. 3 is a plan view of the hand-held gem dop; and

FIG. 4 is a perspective view of the gem dop tool with a semi-precious cab.

DESCRIPTION OF THE INVENTION

The instant invention comprises a hand-held gem dop or cab gripping tool comprising a slender hollow tubular handle having a cup-like upper cavity which communicates with an unthreaded cylindrical cavity which communicates with a threaded cylindrical cavity further down in the handle. A short rod-like member is threaded into the handle so that its upper portion extends above the cup-like cavity. The upper portion preferably has attached thereto a pair of opposed angular jaws which are attached by a pin. Each angular jaw has a forward arm which is attached to the pin passing through the clevis and an upper arm at substantially a right angle to the forward arm which may be adapted to grip a stone or to which gem gripping means may be attached. The jaws are spring biased so that the jaws are normally forced away from one another. The jaws are moved towards one another by threading the rod-like member into the handle so that the angular edge (elbow) of the jaws are forced against the upper rim of the cup-like cavity.

The preferred embodiment is illustrated in the attached drawings. The tubular handle 10 is illustrated with a cup-like portion 11 of larger diameter at its upper extremity and having a flange 12 encircling the upper rim of the cup-like cavity. A rod-like member having a clevis 13 which extends above the flange 12 and, as illustrated in FIG. 2, the rod-like member 13*a* is threaded into the handle below the cup-like cavity. A pair of opposed jaws 14 and 15 are attached by a pin 16 to the clevis 13 attached to the upper portion of the rod. The jaws have lower arms 17 and 18 and upper arms 19 and 20 disposed at about right angles to the lower arms. The gem stone gripping means 21 and 22 are held to the upper portion of the jaws by bolt means 23 and 24. The gem stone gripping means are detachable so that various widths or grips may be attached to hold various sized stones.

FIG. 2 is an elevational view of the cab gripping tool in which the tool is rotated 90° about the longitudinal axis of the handle from the view illustrated in FIG. 1 so that the broad side of the gem or cab gripping means is seen.

Upper arm 15 is T-shaped and has a pair of bolts 23 and 23*a* passing therethrough to clamp the cab gripping means 21 onto the upper arm of the jaw. The cab grip 21 has a pair of ears opposed pins 21*a* and 21*b* which serve to grip the generally oval cab as illustrated further in FIG. 4. The clevis 13 is attached to the rod 13*a* which has a threaded lower end 13*b* which threads into the threaded portion 10*a* of the handle so that the handle may be screwed onto the rod and through the contact of the elbows of the arms of the jaws force the jaws towards one another so that the cab grip means 21 is forced against a cab.

The slender portion 13*c* of rod 13*a* beneath the clevis 13 passes through the cylindrical opening 13*d*. A rubber O-ring 13*c* encircles rod portion 13*a* to preclude grinding grits and sanding grits from working down into the threaded section of the tool. A circular groove in the rod holds the O-ring in place.

A plan view of the device is illustrated in FIG. 3 wherein the opposed grip means 21 and 22 are illustrated attached to the upper arms and illustrating the attachment of the lower arms 17 and 18 to the clevis 13. Spring 25 is wound around the pin in a fashion so that the extensions of the spring overlap the lower arms 17 and 18 and cause the jaws to be forced away from one another. Plates 26 and 27 are threaded to receive the bolts which hold the grip means 21 and 22 in place. Plate 22 is cut away to illustrate the U-shaped slot 21*c* in grip 21 which allows the grip 21 to be easily slid into place by loosening bolts 23 and 23*a* without removing plate 26.

As illustrated in FIG. 4 an oval shaped cab of thin cross-section is held between the opposed jaws. The grip means preferably has ears on each end of the grip means and the grip means preferably is provided in at least two sizes so that the tool can grip both very small and very large cabs. The small grip means has ears which are spaced about 1.8 to about 2.2 centimeters apart, preferably about 2.0 centimeters, while the larger grip means has ears which are spaced about 2.5 to about 3.0 centimeters apart, preferably about 2.8 centimeters. By providing replaceable grip means of different sizes cabs from a size having a major axis of the measured diameter of 2.0 to about 5.0 centimeters may be held by the tool of the instant invention.

The diameter of the handle is generally from about 1.5 to about 2.0 centimeters and the tubular handle is preferably from about 10 to about 12 centimeters, although it can be considerably longer or shorter, if desired. The inner diameter of the cup-like cavity is from about 1.5 to about 2.0 centimeters and the rim has an outer diameter preferably about 2.0 to about 2.5 centimeters greater than the cup-like cavity. The length of travel of the threaded portion within the handle is preferably from about 1.5 to about 2.0 centimeters.

Replacement cab gripping means may be stored in the hollow end of the handle near its base and a plug may be utilized to close the open end of the handle at the base as to retain the extra cab gripping means within the handle.

FIG. 4 is a perspective view of a gem vise holding a cabochon-type gem stone illustrating the gripping action of ears 21*a* and 21*b* and the manner in which the cabochon blank rests upon the upper surface 21*d* of cab grip means 21. The oval shape of the cab results in its overlapping the upper edges 21*d* and 22*d* of cab means 21 and 22, thus receiving substantial support so that the cab can be pressed firmly against a grinder or polisher without danger of breaking. The four point grip provided by ears 21*a*, 21*b*, 22*a* and 22*b* firmly hold the oval cab from being laterally displaced.

The ears are located at opposite ends of the cab grip means so that a substantial opening exists between the ears. More than two ears on a cab grip means would limit the utility of the device inasmuch as the open, four-point grip has particular utility and effectives for gripping the oval cabochon-type gemstones.

The tool of the instant invention is particularly useful inasmuch as a cab may be inserted between the cab grip of the jaws with one hand while forcing the jaws with the other hand to contact the cab between the cab gripping means. The hand holding the cab then overlaps the jaws and holds the jaws against the cab while the handle is then screwed towards the cab with the other hand to snugly embrace the cab between the cab gripping means. The grip of the jaws are not influenced by water or temperature, as is the case with wax-held cab. Furthermore, there is no wax upon the cab to get into the pores and mar the appearance of the stone or require subsequent cleaning operations.

I claim:

1. A hand-held gem dop comprising:

a. a slender hollow tubular handle having a cup-like upper cavity communicating with an unthreaded cylindrical cavity, communicating with a threaded cylindrical cavity;

b. a short rod-like member having a lower threaded portion adapted to thread into the threaded cavity of the tubular handle and an upper portion having a transverse opening therein to accommodate a pin;

c. a pair of opposed angular jaws having pin openings near the forward edge of a base portion, upper members at a sharp angle to said base members having gem gripping means said base portion and upper members integrally joined to form the angular jaws;

d. pin means joining the upper portion of said short rod-like member to said angular jaws and spring means biasing said angular arms away from one another, said short rod-like member screwable into said hollow handle to cause at least a portion of the base members of said angular members to contact the upper rim surface of the cup-like cavity to cause the upper members of the angular arms to move towards one another.

2. The gem dop of claim 1 wherein said tubular handle has a diameter less than about one inch.

3. The gem dop of claim 1 wherein said cup-like cavity has a flat flange encircling its upper rim.

4. The gem dop of claim 1 wherein said rod-like threaded member has a clevis attached at its upper extremity, said clevis having said transverse pin opening therein.

5. The gem dop of claim 4 wherein each base portion of said jaws have a pair of opposed parallel arm extensions which mate between the upright members of the clevis to embrace said arm extensions to hold said arms laterally in position and said pin means passing through said arm extensions and said clevis upright members.

6. The gem dop of claim 1 wherein the diameter of said cup-like cavity is sufficient to accommodate the width of said clevis.

7. The gem dop of claim 1 wherein said gripping means are removably attached to said angular jaw members.

8. A hand-held gem dop comprising:

a. a slender hollow tubular handle having an unthreaded cylindrical cavity communicating with a threaded cylindrical cavity;

b. a short rod-like member having a lower threaded portion adapted to thread into the threaded cavity of the tubular handle and an upper portion having a transverse opening therein to accommodate a pin;

c. a pair of opposed angular jaws having pin openings near the forward edge of a base portion, and upper members joined to said face members at a sharp angle and having gem gripping means;

d. pin means joining the upper portion of said short rod-like member to said angular jaws and spring means biasing said angular jaws away from one another, said short rod-like member screwable into said hollow handle to cause at least a portion of the base member of said angular members to contact the upper rim surface of the upper cavity to cause the upper members of the angular arms to move towards one another.

* * * * *